US011098390B1

(12) United States Patent
Weil, III

(10) Patent No.: US 11,098,390 B1
(45) Date of Patent: Aug. 24, 2021

(54) RUST-PROOF FIREARM SPRINGS

(71) Applicant: Edgar E. Weil, III, Columbus, OH (US)

(72) Inventor: Edgar E. Weil, III, Columbus, OH (US)

( * ) Notice: Subject to any disclaimer, the term of this patent is extended or adjusted under 35 U.S.C. 154(b) by 0 days.

(21) Appl. No.: 17/146,623

(22) Filed: Jan. 12, 2021

(51) Int. Cl.
*C22C 19/05* (2006.01)
*C21D 9/02* (2006.01)
*F41A 19/29* (2006.01)

(52) U.S. Cl.
CPC ..... *C22C 19/056* (2013.01); *C21D 9/02* (2013.01); *C22C 19/055* (2013.01); *F41A 19/29* (2013.01)

(58) Field of Classification Search
CPC ..... C22C 19/056; C22C 19/055; C22F 1/10; F41B 7/003; C21D 9/02
See application file for complete search history.

(56) References Cited

U.S. PATENT DOCUMENTS

| | | | |
|---|---|---|---|
| 7,753,679 | B1 | 7/2010 | Schuetz |
| 10,036,601 | B2 | 7/2018 | DeSomma et al. |
| 2017/0299307 | A1 | 10/2017 | Horch |

OTHER PUBLICATIONS

Special Metals, Inconel alloy 600, catalog, Sep. 8, 2008, 16 pages.
Special Metals, Inconel alloy X-750, catalog, Sep. 4, 2004, 28 pages.
Oberg, Erik and Jones, F.D, Machinery's Handbook, The Machine Shop and Drafting Room Handbook, 12th edition, pp. 506-507, 2 page, 1945.

*Primary Examiner* — Jessee R Roe
(74) *Attorney, Agent, or Firm* — Standley Law Group LLP; Jeffrey S. Standley; Bryan P. Finneran

(57) ABSTRACT

The present invention relates to one or more rust-proof springs for use in a firearm assembly. The rust-proof springs involve a variety of metals combined to create an alloy that does not react with moisture to form rust. The alloy is formed into one or more mechanical coil springs, and the mechanical coil springs are heat treated to improve the structural strength of the springs. The advantage of the rust proof springs for use in the firearm assembly is that the firearms can be exposed to moisture, such as moisture from rain, and the firearm user would not have to worry about rust on the firearm springs later causing issues with the firearm working as intended. Additionally, the one or more springs have high heat resistance properties.

3 Claims, 9 Drawing Sheets

RUST-PROOF FIREARM SPRINGS

CROSS-REFERENCE TO RELATED APPLICATIONS

This application is an original filing, and does not claim priority to any other foreign or domestic filing.

TECHNICAL FIELD

The present invention generally relates to one or more springs within a firearm assembly having the ability to avoid rusting after one or several exposures to moisture. More specifically, the present invention relates to one or more springs comprising chromium and nickel that have been subjected to a heat treatment process in some preferred embodiments, where the chromium and nickel springs have the ability to avoid rusting after one or more exposures to moisture.

BACKGROUND

Firearms, including rifles such as the AR-15, have long been used for warfare, law enforcement, military training, hunting, and a variety of sporting competitions and recreational activities. A firearm user relies on a multitude of springs maintained within a firearm assembly ("firearm springs") to discharge one or more rounds of ammunition when the firearm user engages a firearm trigger. Failure of the firearm to discharge one or more rounds of ammunition when the firearm trigger is engaged ("firing issue") by a soldier or law enforcement officer may lead to the death or injury of the soldier or law enforcement officer, and/or the death or injury of fellow soldiers or law enforcement officers based on the failure of said soldier or law enforcement officer to use his or her weapon to neutralize one or more enemy combatants or criminals. Additionally, a firing issue for a hunter, military cadet or trainee, shooting competition participant, or recreational shooter may lead to the escape of a targeted animal, the lack of success with a military training exercise, or the failure to compete or participate in the competition or activity. Thus, it is often imperative that the springs maintained within a firearm assembly function as intended when the firearm is being used.

Firearms are generally used in outdoor environments where the weapon may potentially be exposed to moisture, including moisture from precipitation, surface water, dew or water vapor. Traditionally, the firearm springs are composed of a plurality of coils made from music wire, which is tempered high-carbon steel. A major issue with music wire is that when music wire is exposed to moisture, oxygen ($O_2$) and water ($H_2O$) from the moisture oxidize ferrous iron (Fe(II)) from the tempered high-carbon steel to form hydrated iron oxide ($Fe_2O_3H_2O$), also known as rust. Other materials that have been used to make prior art firearm springs, but less commonly, include chrome silicon, oil tempered, 17-4 stainless steel, and 302 stainless steel.

The presence of rust on one or more firearm springs could lead to a firing issue for several reasons. The $Fe_2O_3H_2O$ molecules present define corrosion of the music wire. These molecules in sufficient amounts may be characterized as a flaky, powder-like substance, and having replaced the ferrous iron from the tempered high-carbon steel, necessarily reduce the mobility and structural integrity of the spring. When a firearm spring breaks/snaps or fails to move as intended when engaged as a result of corrosion ("spring rust issue(s)"), a firing issue becomes likely. With respect to a magazine catch spring, a spring rust issue may lead to the failure of any ammunition to be fed into a chamber of the firearm. Additionally, with respect to an extractor spring, a spring rust issue may lead to a cartridge case becoming stuck in the chamber of the weapon. Furthermore, with respect to a hammer spring, a spring rust issue may lead to the failure of a hammer to engage a firing pin, thus preventing the weapon from firing. Firing issues related to the presence of rust on one or more springs, including but not limited to the aforementioned exemplary springs, are described in more detail below.

Traditionally speaking, the solution to the spring rust issue was to replace corroded springs with new springs, or replace the entire weapon with a separate effective weapon. However, replacing one or several springs, including paying a gunsmith to replace said springs, or replacing a weapon as a whole may be inconvenient, time consuming and/or expensive. Additionally, with respect to rust issues not detected before a battle, engagement, activity, or other event involving the weapon, it may not be possible to replace springs or the weapon as a whole while the battle, engagement, activity, or other event is ongoing.

Another issue with prior art firearm springs in certain applications is that they do not maintain their desired properties at high temperatures. This can become problematic as the temperature inside a firearm can become quite high. The maximum operating temperature of music wire springs is approximately 250 degrees Fahrenheit, while the maximum operating temperature of other prior art firearm spring materials is as follows:

| Material | Maximum Operating Temperature (° F.) |
|---|---|
| Chrome Silicon | 475 |
| Oil Tempered | 250 |
| 17-4 Stainless | 600 |
| 302 Stainless | 550 |

In view of this, it would be useful to develop a plurality of springs to be included in a firearm assembly where the firearm springs comprise a variety of metallic elements that in combination are not susceptible to rust formation ("rust-proof springs") and which exhibit high maximum operating temperature compared to the springs of the prior art.

SUMMARY

It is an objective of the present invention to provide a plurality of rust-proof, high maximum operating temperature springs to be incorporated into a firearm assembly. The rust-proof springs of the present invention comprise a variety of metallic elements that in combination withstand repeated moisture exposures without developing rust and work up to high ambient temperatures. The combination is primarily a nickel and chromium alloy, the alloy having known resistance properties with respect to corrosion and oxidation. Structurally speaking, the combination may be strengthened by a heat treatment process described in more detail below. The object of strengthening one or more springs by heat treatment is to further prevent spring mobility issues or the breaking or snapping of a firearm spring. Exemplary embodiments of the present invention include the combination formed into a plurality of coils defining a rust-proof spring, where the coils may be formed in various shapes and diameters, and the springs may be formed at various lengths in accordance with firearm assembly requirements.

When a firearm is exposed to moisture, including moisture from precipitation, surface water, or dew or water vapor, said moisture may contact springs located on the exterior of the firearm, such as a trigger spring, or may infiltrate cavities or openings in the firearm to contact springs located in the interior of the firearm, such as a forward assist spring. Moreover, firearms are often exposed to and come into contact with other high moisture elements (i.e. mud and muck) that can cause corrosion of the firearm springs of the prior art. A firearm including exemplary embodiments of the present invention as opposed to prior art springs will not experience spring rust issues resulting from exposure to the moisture, because the incorporated alloy does not chemically react with $O_2$ or $H_2O$. Thus, with respect to the present invention, firing issues related to the presence of rust on one or more springs incorporated in the firearm are avoided. Further, the inventive springs do not deteriorate when exposed to high ambient temperatures that may be present in some firing situations.

With the above objectives in view, the present invention specifically discloses rust-proof springs for firearms wherein said springs are made from an alloy comprising at least 70% nickel, 14-17% Chromium, at least 5% iron, and several other metals identified in more detail below. In one preferred exemplary embodiment, there is provided a spring made from a first alloy comprising at least 72% nickel, 14-17% chromium, 6-10% iron, and no more than 0.15% carbon, 1% manganese, 0.015% sulfur, and 0.5% silicon and copper. The combination thereof is heat treated to achieve a desired linear expansion, and cooled thereafter to achieve a desired increase in maximum stress characteristics. The heat treatment is preferably placing the springs in an oven at 600° F. for one hour and then allowing the springs to cool (preferably by removing from oven and allowing the springs to return naturally to room temperature). Prior to the aforesaid heat treatment, the springs may be run through a conveyor oven at 900° F. This conveyor oven process preferably sets the springs in their desired configuration before the subsequent heat treatment, etc.

In a second preferred exemplary embodiment, there is provided a spring made from a second alloy comprising at least 70% nickel, 14-17% chromium, 5-9% iron, 2.25-2.75% titanium, 0.40-1.00% aluminum, 0.70-1.20% Niobium, and no more than 1% manganese, 0.50% silicon, 0.01% sulfur, 0.50% copper, 0.08% carbon, and 1% cobalt. The object of the second aspect herein is to maximize stress characteristics resulting from heat treatment. In certain preferred embodiments, the aforementioned combination is heated to achieve a linear expansion of 8-9 in./in./° F.*$10^{-6}$ from room temperature (70° F.) to 1200° F. for four hours, and cooled thereafter (preferably by removing from heat and allowing to cool naturally to room temperature) to achieve a maximum stress level of at least 100 ksi. Prior to the aforesaid heat treatment, the springs may be run through a conveyor oven at 900° F. This conveyor oven process preferably sets the springs in their desired configuration before the subsequent heat treatment, etc.

According to the present invention in another aspect, springs comprising an exemplary nickel and chromium mixture are specifically configured for use with an AR-15 or AR-10 rifle. The AR-15 is a rapid-fire rifle with particular popularity in the United States in part because the weapon is accurate, includes a wide variety of calibers, and a user has the ability to interchange various parts of the weapon for optimized use. The AR-10 is similar in design to the AR-15, although the AR-10 is heavier, and involves larger rounds and a greater effective firing range.

The descriptions set out above are merely exemplary preferred versions of the invention. Numerous additions and modifications may be made. These examples should not be construed as describing the only possible version of the invention, and the true scope of the invention will be defined more fully from the following detailed description and the attached claims.

BRIEF DESCRIPTION OF THE DRAWINGS

Other features and advantages disclosed herein will become more apparent from the following detailed description of exemplary embodiments when read in conjunction with the attached drawings, wherein.

All drawings are schematic and not necessarily to scale. Parts given a reference numerical designation in one figure may be considered to be the same parts where they appear in other figures without a numerical designation for brevity unless specifically labeled with a different part number and/or described herein. Parts described herein with respect to certain figures may also appear in other figures. Furthermore, a general reference to a whole figure number which may include multiple subparts shall be construed as a reference to all of the subparts unless specifically noted otherwise.

DETAILED DESCRIPTION

In the description of embodiments disclosed herein, any reference to direction or orientation is merely intended for convenience of description and is not intended in any way to limit the scope of the present invention.

Figure 1:
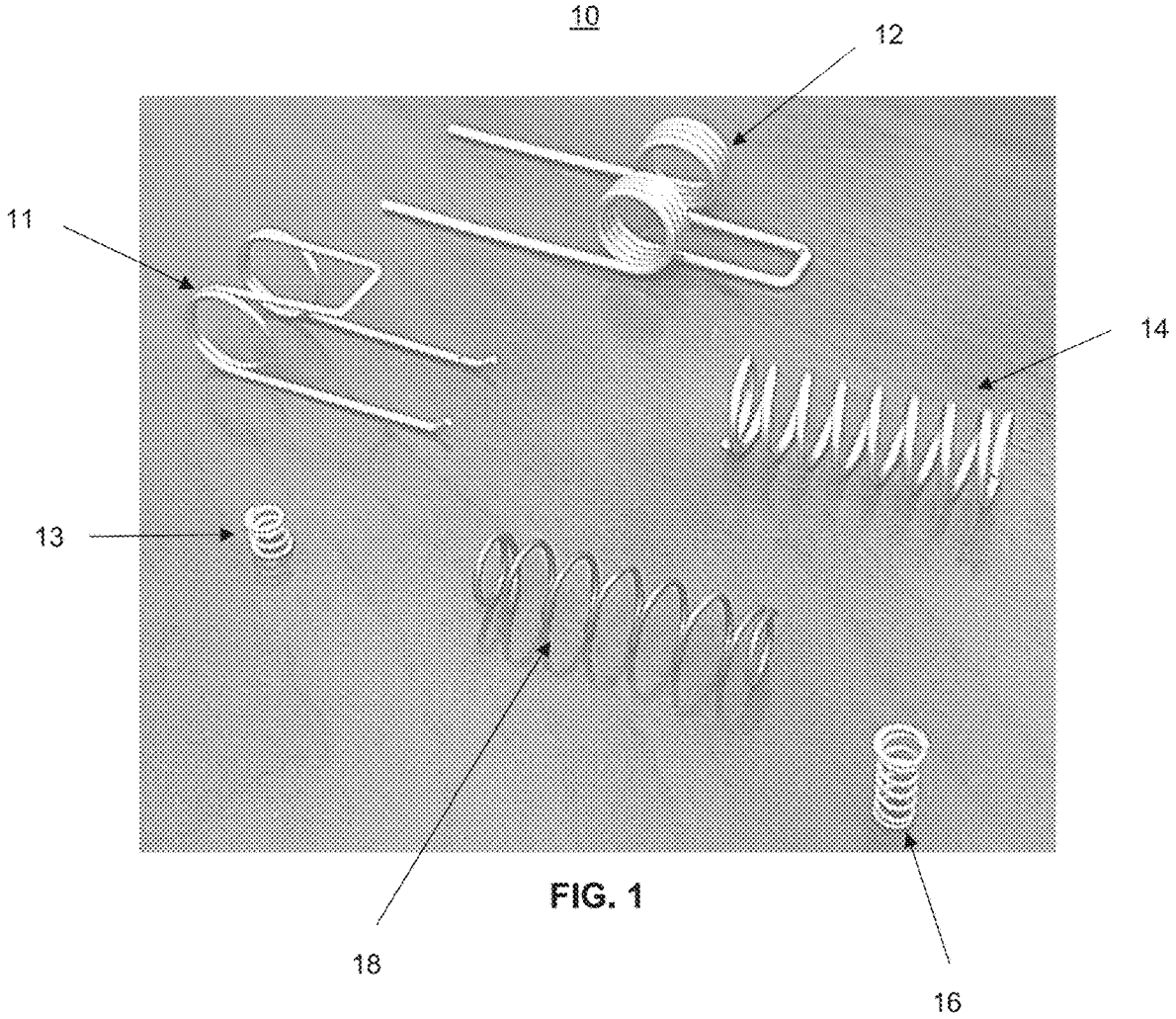
FIG. 1 is a perspective view of a plurality of springs from an exemplary AR-15/AR-10 spring kit.

Referring now to FIG. 1, a plurality of mechanical coil springs from an exemplary AR-15/AR-10 spring kit 10 of the present invention are shown. Included in the exemplary AR-15/AR-10 spring kit 10 are a trigger spring 11, a hammer spring 12, an extractor spring 13, a forward assist spring 14, a disconnector spring 16, and a magazine catch spring 18. The functions of each spring from the AR-15/AR-10 spring kit 10 are indicated below. In certain preferred embodiments, at least some of the springs comprise a plurality of coils made from a first exemplary alloy (hereinafter "first exemplary alloy"), the first exemplary alloy comprising a combination of at least 72% nickel, 14-17% chromium, 6-10% iron, and no more than 0.15% carbon, 1% manganese, 0.015% sulfur, 0.5% silicon, and 0.5% copper. In a preferred exemplary embodiment, the inventive springs comprising the first exemplary alloy are made entirely of the first exemplary alloy. In some embodiments, the first exemplary alloy comprises an INCONEL® alloy 600. The exemplary springs are heat treated in preferred exemplary embodiments for structural strengthening according to a heat treatment process described in more detail below. Some exemplary embodiments may comprise a spring comprising, or made entirely from, the first exemplary alloy wherein said spring is not part of a kit 10.

In a second exemplary embodiment of a spring kit 10 of the present invention, at least some of the springs comprise a second exemplary alloy (hereinafter "second exemplary alloy") that comprises a combination of at least 70% nickel, 14-17% chromium, 5-9% iron, 2.25-2.75% titanium, 0.40-1.00% aluminum, 0.70-1.20% Niobium, and no more than 1% manganese, 0.50% silicon, 0.01% sulfur, 0.50% copper, 0.08% carbon, and 1% cobalt. In some embodiments, the second exemplary alloy comprises an INCONEL® alloy X-750. The exemplary springs are heat treated in preferred exemplary embodiments for structural strengthening according to a heat treatment process described in more detail below. Some exemplary embodiments may comprise a spring comprising, or made entirely from, the second exemplary alloy wherein said spring is not part of a kit 10. In some exemplary embodiments of a kit 10, some of the springs of the kit may comprise the first exemplary allow while the remainder of the springs comprise the second exemplary alloy. In some exemplary embodiments, kit 10 comprises all of the springs needed to make a firearm.

Some exemplary embodiments comprise at least one spring, or a kit 10 comprising a plurality of springs, wherein at least one spring comprises, or is made entirely from, an alloy comprising at least 70% nickel, 14-17% Chromium, and at least 5% iron (hereinafter the "third exemplary alloy"). In preferred exemplary embodiments, the third exemplary alloy comprises less than 1% carbon and preferably less than 0.5% carbon.

The first exemplary alloy, second exemplary alloy, and third exemplary alloy do not chemically react with $O_2$ or $H_2O$, thus rust formation or corrosion resulting from oxidation of ferrous iron is not an issue with the exemplary alloys. The coil diameters and spring lengths are sized according to the requirements of the AR-15/AR-10 assembly. In some embodiments the desired spring dimensions may be obtained and/or "set" into place by running the springs through a conveyor oven at 900° F. Moreover, the first exemplary alloy and second exemplary alloy are generally resistant to relatively high temperatures as provided by the exemplary operating temperature ranges below:

| Material | Operating Temperature Range (° F.) |
|---|---|
| First Exemplary Alloy | −238 to 2000 and up |
| Second Exemplary Alloy | 0 to 1300 |

A useful strength for at least some of the preferred exemplary firearm springs made using the second exemplary alloy is 1200° F. Operating Temperature Ranges for the first exemplary alloy and second exemplary alloy may be increased by heat treating the materials. For example, a firearm spring made from the second exemplary alloy that has been heat treated as discussed herein may be capable of operating without degradation under ambient temperatures as high as 1800° F. in some exemplary embodiments. The third exemplary alloy similarly has high operating temperature ranges in exemplary embodiments.

Figure 2:
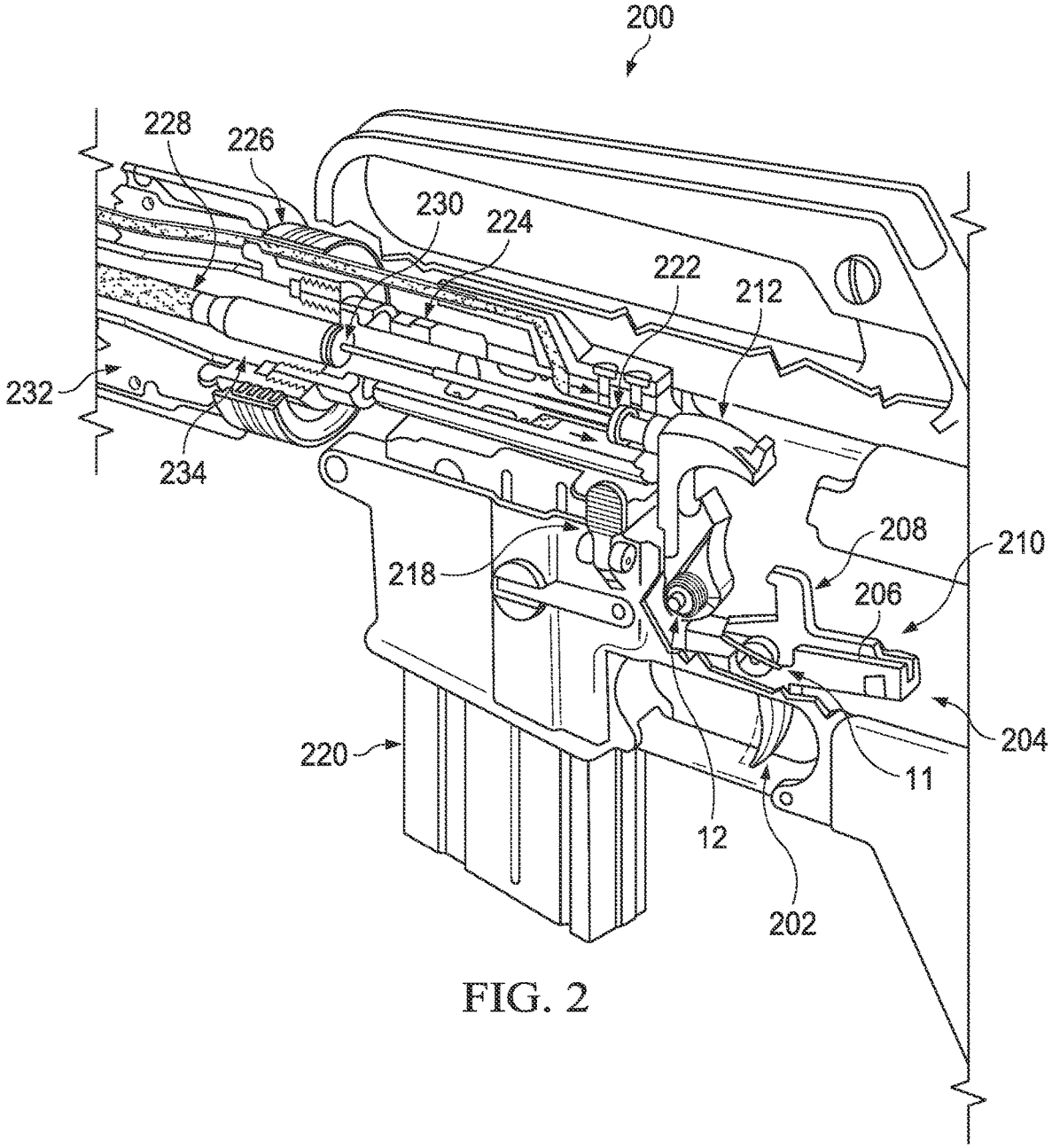
FIG. 2 is a perspective view illustration of an AR-15 rifle mid-section comprising an AR-15 magazine and trigger group assembly having a hammer pivotably linked to a bolt-carrier group.

Referring now to FIG. 2, an illustration of an AR-15 rifle mid-section 200 comprising an AR-15 magazine 220 and trigger group assembly 210 having a hammer 212 pivotably linked to a firing pin 222 positioned at the rear of a bolt-carrier group 224 is shown, where the bolt-carrier group 224 extends towards a receiver 226, and is linked to a barrel 228 of the AR-15. Ammunition stored in the magazine 220 is fed into a chamber 234 positioned behind the barrel 228 by a magazine catch spring (not shown), the magazine catch spring being positioned behind a magazine release button 218. A forward assist spring (not shown) is located at a lower portion 232 of the receiver 226. The trigger group assembly 210 controls when ammunition in the chamber 234 is discharged. The trigger group assembly 210 includes a trigger having a trigger knob 202 and a trigger rear portion 204 with a top end 206, a trigger spring 11, a disconnector 208, a hammer 212, and a hammer spring 12. The disconnector 208 is linked to the trigger rear portion 204 by a disconnector spring (not shown). When the trigger knob 202 is pulled towards the trigger rear portion 204 by a user, force is directed to the hammer spring 12, and the hammer 212 is thrust forward by the hammer spring 12 to engage a firing pin 222, which strikes a cartridge primer 230, which initiates the discharge. The disconnector 208 maintains the hammer 212 behind the firing pin 222 after the trigger knob 202 is released by the user. The trigger knob 202 is returned to its original position by the trigger spring 11.

In one preferred embodiment, at least some of the springs shown in FIG. 2 comprise, and are preferably made entirely from, the first exemplary alloy. In another preferred embodiment, at least some of the springs shown in FIG. 2 comprise, and are preferably made entirely from, the second exemplary alloy. These exemplary embodiments may be heat treated prior to use as discussed below.

Figure 3A:
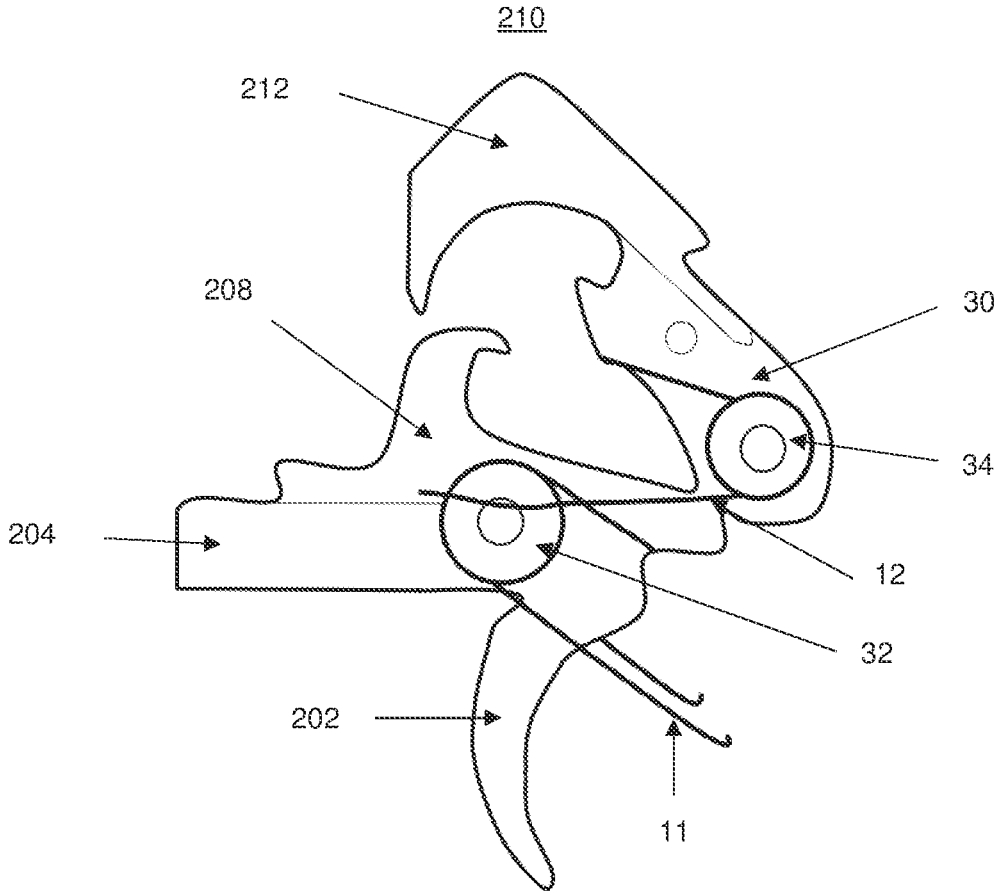
FIG. 3A is a side view illustration of an AR-15 trigger group assembly.

FIG. 3A illustrates a side view of the trigger group assembly 210 of the FIG. 2 embodiment. The trigger group assembly 210 includes the hammer 212 engaged by the hammer spring 12 at a bottom portion 30 of the hammer 212. The disconnector 208 is shown positioned above the trigger rear portion 204, which is positioned above the trigger knob 202. The trigger knob 202 is pivotably controlled by the trigger spring 11. The trigger spring 11 is secured to the trigger group assembly 210 by a trigger spring mount 32, and the hammer spring 12 is secured to the trigger group assembly 210 by a hammer spring mount 34.

Figure 3B:
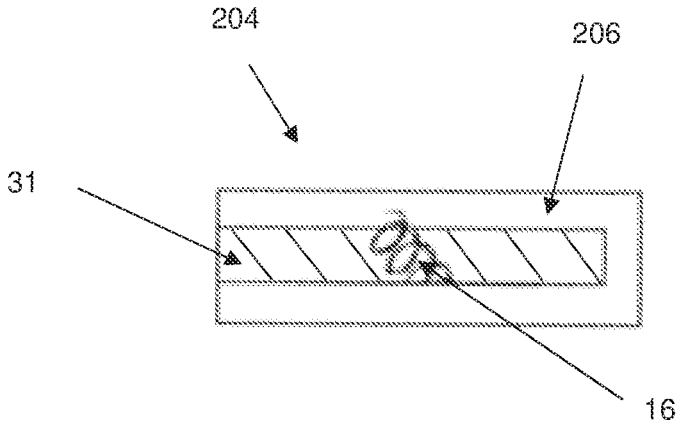
FIG. 3B is a cross-sectional top perspective view illustration of a rear portion of an AR-15 trigger.

FIG. 3B illustrates the interior 31 of the trigger rear portion 204 of the FIG. 3A embodiment. Shown between the top ends 206 of the trigger rear portion 204 is the disconnector spring 16. Referring now to FIGS. 3A-B, the disconnector spring 16 functions to cause the disconnector 208 to hold back the hammer 212 after the trigger knob 202 is released, thus preventing the weapon from firing when the trigger knob 202 is not being pulled back towards the trigger rear portion 204. Based on the aforementioned figures and descriptions, it should be apparent to one of ordinary skill in the art that various firearm springs are critical to ensuring that a weapon is discharged when the trigger knob 202 is engaged, and at no other times. FIGS. 4A-9B illustrate various exemplary springs of the FIG. 1 embodiment.

Figure 4A:
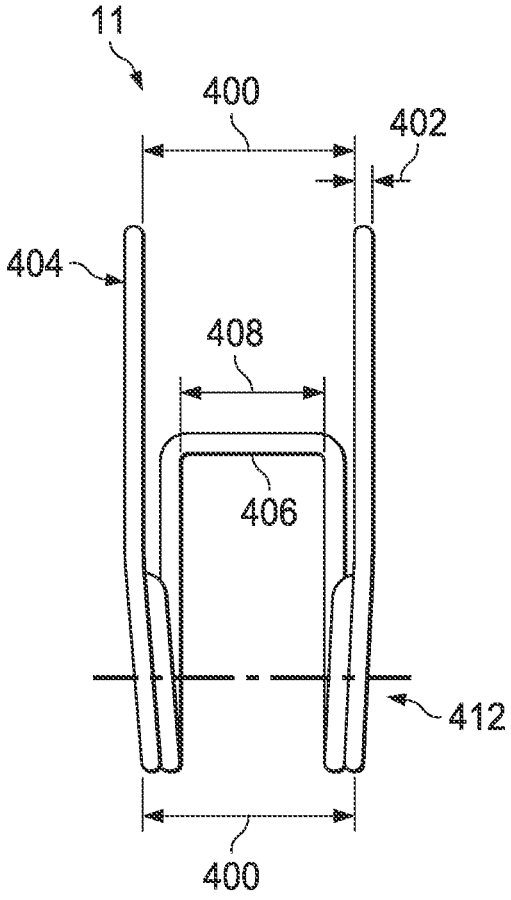
FIG. 4A is a rear-view illustration of an exemplary trigger spring of the FIG. 1 embodiment.
Figure 4B:
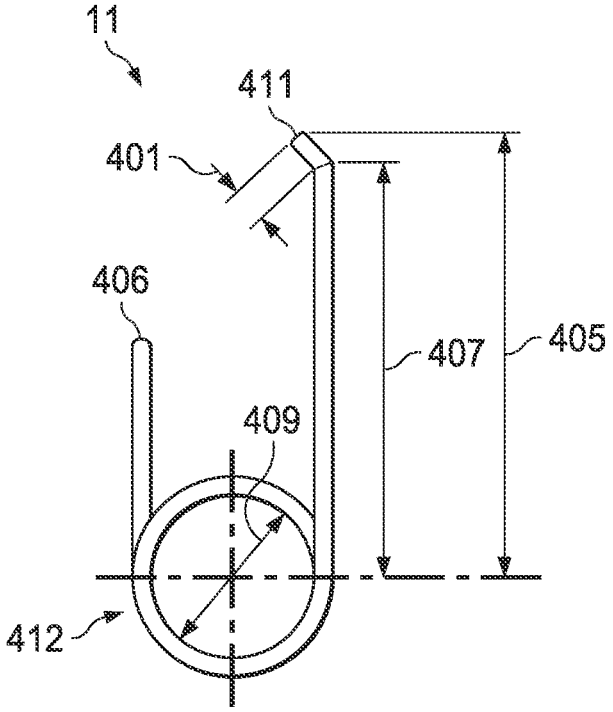
FIG. 4B is a side view illustration of an exemplary trigger spring of the FIG. 1 embodiment.

Referring now to FIGS. 4A-B, an exemplary trigger spring 11 of the FIG. 1 embodiment is shown. In certain preferred embodiments, the trigger spring 11 comprises a plurality of main coils 412 having a diameter 409, legs 404, a wrap coil 406, and notches 411, where the aforementioned spring parts comprise at least one material selected from the group consisting of the first exemplary alloy, the second exemplary alloy, and a mixture comprising the first exemplary alloy and second exemplary alloy. In some preferred embodiments of trigger spring 11, the coil diameter 409 is 0.36 inches, a coil thickness 402 is 0.036 inches, the wrap coil 406 length 408 is 0.31 inches, the leg 404 length 407 is 0.95 inches, the notch 411 has a length 401 of 0.06 inches, the leg 404 and notch 411 have a combined length 405 of 1.02 inches, and the legs 404 are spaced apart 400 approximately 0.45 inches.

Referring back to FIGS. 2 and 3A, the function of the trigger spring 11 is to engage the trigger knob 202 with torque from the trigger spring 11, repositioning the trigger knob 202 in its original position away from the trigger rear portion 204 after the weapon has been fired. A spring rust issue or issue caused by high heat may compromise the mobility of the trigger spring 11, or may cause the trigger spring 11 to snap or break, which may lead to a loss of user control of the trigger, preventing the weapon from firing and/or causing the weapon to fire when the user does not intend for the weapon to fire. The first exemplary alloy and second exemplary alloy do not chemically react with $O_2$ or $H_2O$, thus rust formation or corrosion of the trigger spring 11 resulting from oxidation of ferrous iron is not an issue. Thus, issues with rust from moisture exposure on the trigger spring 11 causing a loss of user control of the trigger knob 202 are avoided by the present invention. Moreover, the first exemplary alloy and second exemplary alloy have a high maximum operating temperature ("high heat resistance") compared to prior art materials used in the fabrication of firearm springs.

Figure 5A:
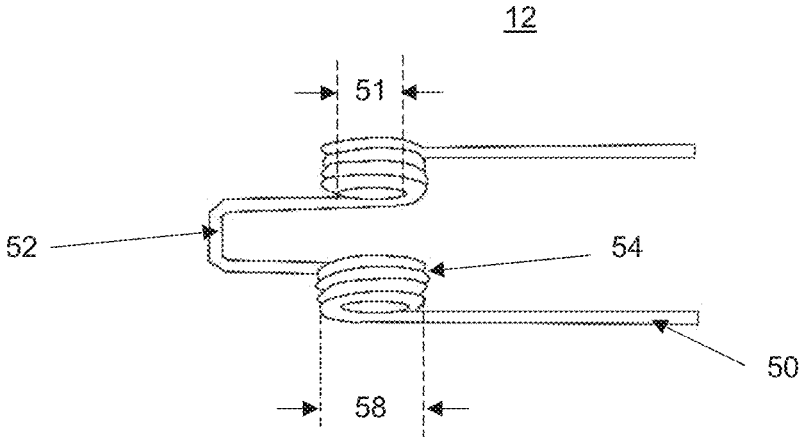
FIG. 5A is a top perspective view illustration of an exemplary hammer spring of the FIG. 1 embodiment.
Figure 5B:
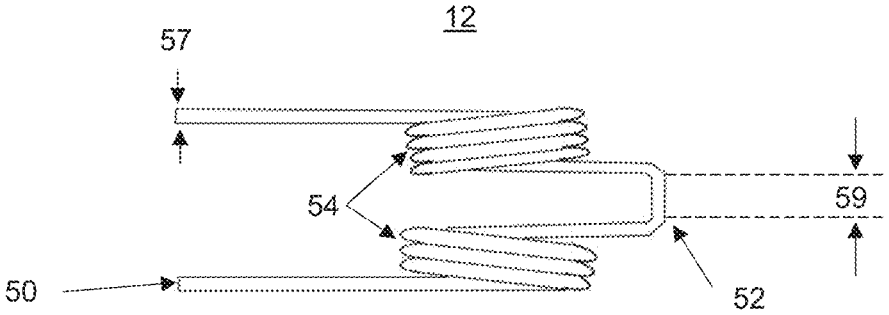
FIG. 5B is a top view illustration of an exemplary hammer spring of the FIG. 1 embodiment.
Figure 5C:
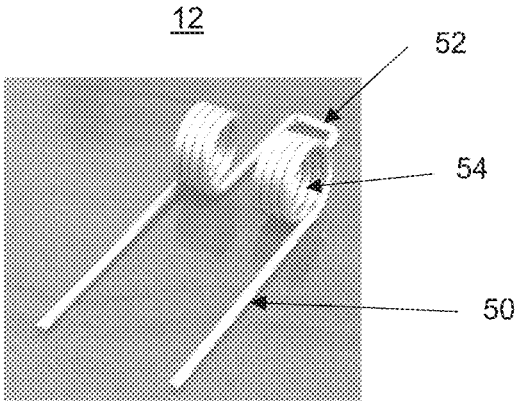
FIG. 5C is a perspective view of an exemplary hammer spring of the FIG. 1 embodiment.

Referring to FIGS. 5A-C, an exemplary hammer spring 12 of the FIG. 1 embodiment is shown. In certain preferred embodiments, the hammer spring 12 comprises a plurality of main coils 54 having an inner diameter 51 and outer diameter 58, legs 50, and a wrap coil 52, where the aforementioned spring parts comprise at least one material selected from the group consisting of the first exemplary alloy, the second exemplary alloy, and a mixture comprising the first exemplary alloy and the second exemplary alloy. In some preferred embodiments, the inner coil diameter 51 is approximately 0.345 inches, the outer coil diameter 58 is approximately 0.497 inches, a coil thickness 57 is approximately 0.043 inches, the wrap coil 52 length 59 is approximately 0.345 inches, the leg 50 length is approximately 1.32 inches, and the legs 50 are spaced apart 0.67 inches.

Referring back to FIGS. 2 and 3A in addition to FIGS. 5A-C, the function of the hammer spring 12 is to cause the hammer 212 to rotate towards a firing pin 222 and strike the firing pin 222, causing the firing pin 222 to strike a cartridge primer 230, causing a round to be discharged from the barrel 228 of the weapon. The hammer spring 12 causes said rotation of the hammer 212 by tension in the legs 50 of the hammer spring 12 forcing the wrap coil 52 to apply torque to the bottom portion 30 of the hammer 212. Said tension in the legs 50 of the hammer spring 12 is the product of a user engaging the trigger knob 202 by pulling the trigger knob 202 back towards the trigger rear portion 204. A spring rust issue may compromise the mobility of the hammer spring 12, or may cause the hammer spring 12 to snap or break, which may lead to a firing issue resulting from a failure to strike the firing pin 222. The first exemplary alloy and the second exemplary alloy do not chemically react with $O_2$ or $H_2O$, thus rust formation or corrosion of the hammer spring 12 resulting from oxidation of ferrous iron is not an issue. Thus, firing issues related to rust from moisture exposure on the hammer spring 12 preventing proper movement of the hammer 212 are avoided. Moreover, the first exemplary alloy and second exemplary alloy have high heat resistance compared to prior art materials used in the fabrication of firearm springs.

Figure 6:
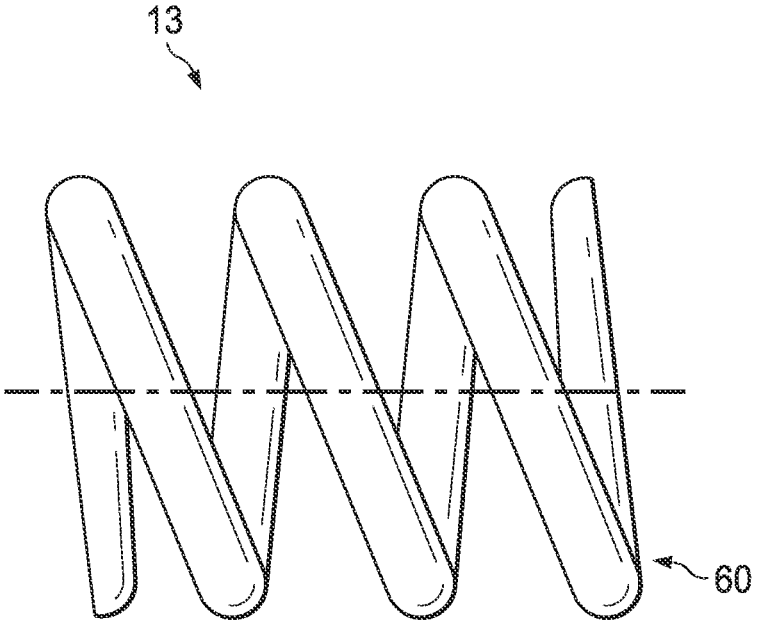
FIG. 6 is a side view illustration of an exemplary extractor spring of the FIG. 1 embodiment.

FIG. 6 illustrates an exemplary extractor spring 13 of the FIG. 1 embodiment. In certain preferred embodiments, the extractor spring 13 comprises a plurality of coils 60 comprising at least one material selected from the group consisting of the first exemplary alloy, the second exemplary alloy, and a mixture comprising the first exemplary alloy and the second exemplary alloy. In some preferred embodiments, the diameter of the coils 60 is 0.151 inches, and the length of the extractor spring 13 is 0.167 inches. Referring now to FIGS. 2 and 6, the function of the extractor spring 13 is to remove casings of previously fired cartridges from the chamber 234 so that new rounds of ammunition can be loaded from the magazine 220 to the chamber 234 for firing. A spring rust issue may compromise the mobility of the extractor spring 13, or may cause the extractor spring 13 to snap or break, which may cause the weapon to become jammed, meaning new rounds cannot be loaded into the chamber 234. The first exemplary alloy and second exemplary alloy do not chemically react with $O_2$ or $H_2O$, thus rust formation or corrosion of the extractor spring 13 resulting from oxidation of ferrous iron is avoided. Thus, firing issues related to rust from moisture exposure on the extractor spring 13 are avoided. Moreover, the first exemplary alloy and second exemplary alloy have high heat resistance compared to prior art materials used in the fabrication of firearm springs.

Figure 7A:
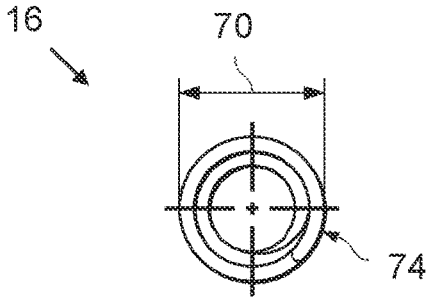
FIG. 7A is a front view illustration of an exemplary disconnector spring of the FIG. 1 embodiment.
Figure 7B:
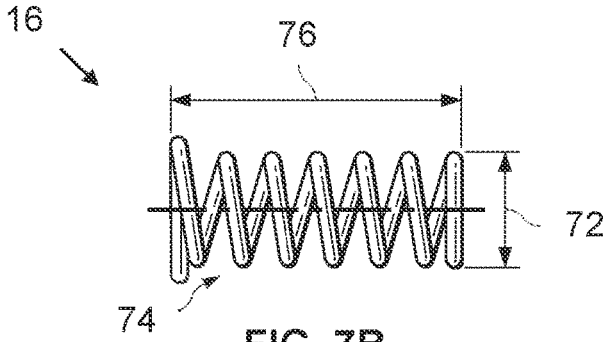
FIG. 7B is a side view illustration of an exemplary disconnector spring of the FIG. 1 embodiment.

Referring now to FIGS. 7A-B, an exemplary disconnector spring 16 of the FIG. 1 embodiment is shown. In certain preferred embodiments, the disconnector spring 16 has a length 76 and comprises a series of coils 74 having a first diameter 70 on one end, and a second diameter 72 on another end. The disconnector spring 16 comprising at least one material selected from the group consisting of the first exemplary alloy, the second exemplary alloy, and a mixture comprising the first exemplary alloy and second exemplary alloy. In some preferred embodiments, the length 76 of the disconnector spring is 0.366 inches, the first diameter 70 is approximately 0.18 inches, and the second diameter 72 is approximately 0.148 inches. Referring back to FIGS. 2 and 3A-B, the function of the disconnector spring 16 is to isolate the hammer 212 from the firing pin 222 when the trigger knob 202 is not being engaged by the user so as to prevent the weapon from firing when the user does not intend it to fire. The disconnector 208 forces the hammer 212 away from the firing pin 222 through tension applied by the disconnector spring 16. A spring rust issue may compromise the mobility of the disconnector spring 16, or may cause the disconnector spring 16 to snap or break, which may lead to a lack of user ability to control when the weapon is discharged. The first exemplary alloy and second exemplary alloy do not chemically react with $O_2$ or $H_2O$, thus rust formation or corrosion of the disconnector spring 16 resulting from oxidation of ferrous iron is not an issue. Thus, firing issues related to rust from moisture exposure on the disconnector spring 16 causing a failure to control the hammer 212 are avoided.

Figure 8A:
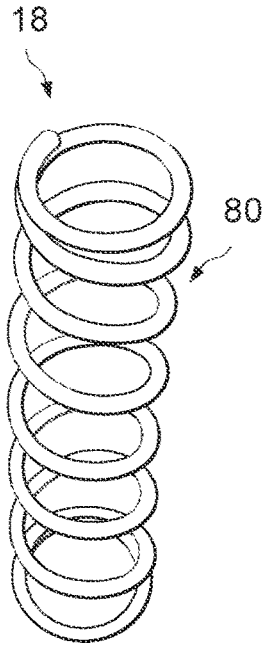
FIG. 8A is a perspective view of an exemplary magazine catch spring of the FIG. 1 embodiment.
Figure 8B:
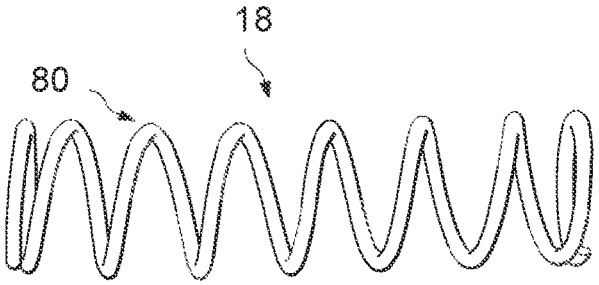
FIG. 8B is a side view of an exemplary magazine catch spring of the FIG. 1 embodiment.
Figure 8C:
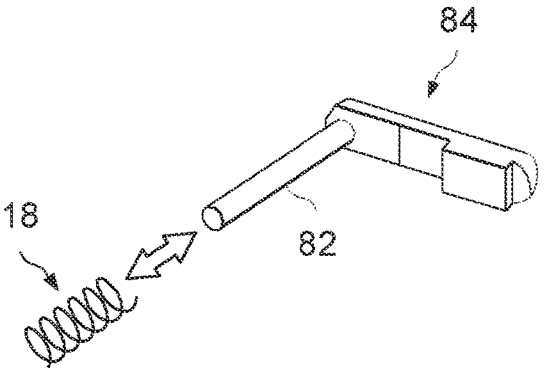
FIG. 8C is a perspective view illustration of an AR-15 magazine catch and exemplary magazine catch spring.

Referring to FIGS. 8A-C, an exemplary magazine catch spring 18 of the FIG. 1 embodiment is shown. In certain preferred embodiments, the magazine catch spring 18 comprises a series of coils 80, each coil 80 comprising at least one of the exemplary alloys of the FIG. 1 embodiment. In some preferred embodiments, the length of the magazine catch spring 18 is 0.270 inches. Referring back to FIG. 2 in addition to FIG. 8C, the function of the magazine catch spring 18 is to feed ammunition from the magazine 220 into the chamber 234 of the weapon. The spring repositions ammunition from the magazine 220 to the chamber 234 from a magazine catch 84 having a magazine catch spring rod 82. A spring rust issue may compromise the mobility of the magazine catch spring 18, or may cause the magazine catch spring 18 to snap or break, which may lead to a firing issue caused by a lack of ability to reload the weapon. The exemplary alloys of the FIG. 1 embodiment do not chemically react with $O_2$ or $H_2O$, thus rust formation or corrosion of the magazine catch spring 18 resulting from oxidation of ferrous iron is not a concern with the present invention. Thus, firing issues related to rust from moisture exposure on the magazine catch spring 18 causing lack of ability to reload the weapon are avoided. Moreover, the first exemplary alloy and second exemplary alloy have high heat resistance compared to prior art materials used in the fabrication of firearm springs.

Figure 9A:
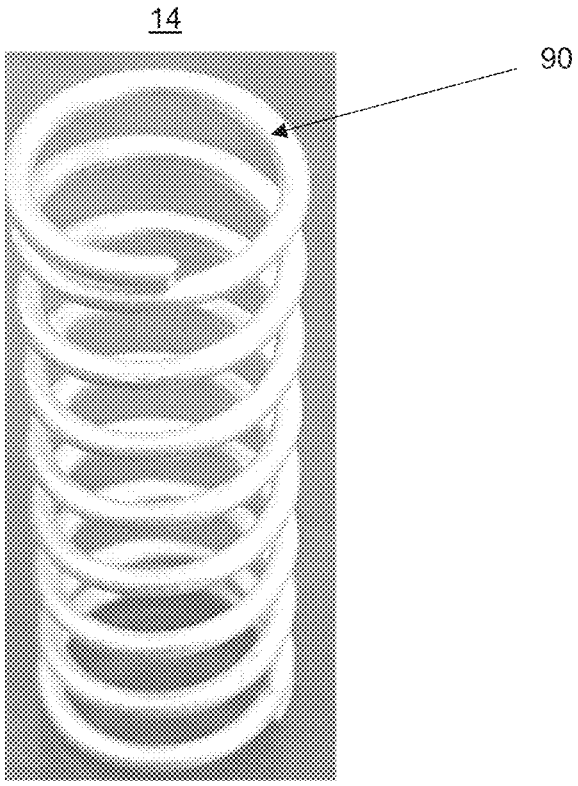
FIG. 9A is a perspective view of an exemplary forward assist spring of the FIG. 1 embodiment.
Figure 9B:
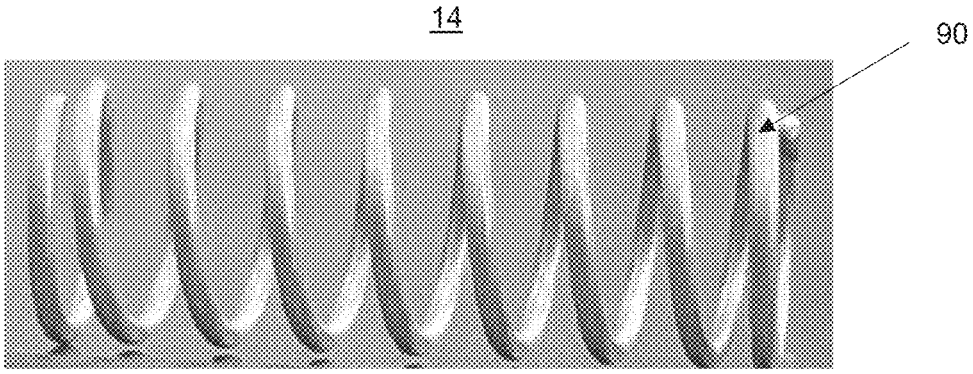
FIG. 9B is a side view of an exemplary forward assist spring of the FIG. 1 embodiment.

FIGS. 9A-B illustrate an exemplary forward assist spring 14 of the FIG. 1 embodiment. In certain preferred embodiments, the forward assist spring 14 comprises a series of coils 90, each coil 90 comprising at least one material selected from the group consisting of the first exemplary alloy, the second exemplary alloy, and a mixture comprising the first exemplary alloy and the second exemplary alloy. Referring back to FIG. 2 in addition to FIGS. 9A-B, the function of the forward assist spring 14 is to direct motion of the bolt carrier group 224. A spring rust issue may compromise the mobility of the forward assist spring 14, or may cause the forward assist spring 14 to snap or break, which may lead to a firing issue caused by a faulty bolt carrier group 224. The exemplary alloys of the FIG. 1 embodiment do not chemically react with $O_2$ or $H_2O$, thus rust formation or corrosion of the forward assist spring 14 resulting from oxidation of ferrous iron is not an issue. Thus, firing issues related to rust from moisture exposure on the forward assist spring 18 causing a faulty bolt carrier group 224 are avoided. Moreover, the first exemplary alloy and second exemplary alloy have high heat resistance compared to prior art materials used in the fabrication of firearm springs.

Figure 10:
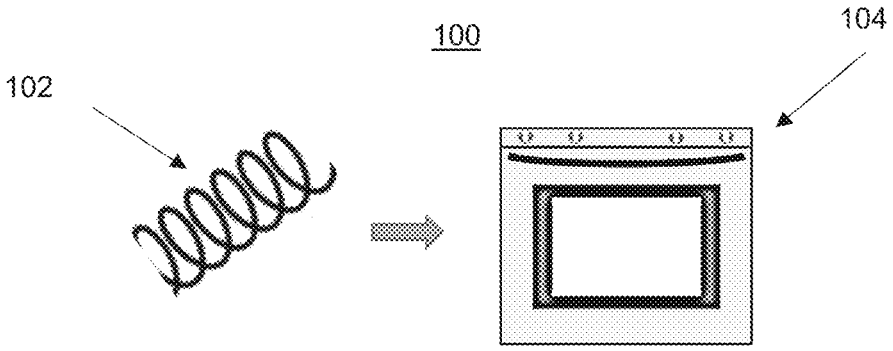
FIG. 10 is a side view illustration of a system and method for heat treating the exemplary springs of the present invention before introducing the springs into a firearm assembly.

FIG. 10 illustrates an exemplary system and method for heat treating 100 the exemplary springs 102 of the present invention before introducing the springs 102 into a firearm assembly. The exemplary springs 102 comprising an exemplary nickel and chromium alloy are heat treated to improve the structural stability of the springs 102, further preventing the springs 102 from having mobility issues, or snapping or breaking. The exemplary alloy is heated in a forge/oven 104 to achieve a desired linear expansion, and cooled thereafter to achieve a desired increase in maximum stress characteristics. In certain preferred embodiments in which at least one spring comprises the first exemplary alloy, the at least one spring is heated at 800° F. for one hour. In certain preferred embodiments in which at least one spring comprises the second exemplary alloy, the at least one spring is heated for four hours at 1200° F. to achieve a desired linear expansion of 8-9 in./in./° F.*$10^{-6}$ from room temperature (70° F.) to 1200° F., and cooled thereafter to achieve a maximum stress level of at least 100 ksi. In some exemplary embodiments, at least one spring is processed through a conveyor oven at 900° F. prior to subjecting the at least one spring to one of the foregoing heat treatments.

A preferred exemplary embodiment of the present invention comprises a kit 10 of springs wherein some of the springs of the kit 10 are made entirely from the first exemplary alloy and the remainder of the springs of the kit 10 are made entirely from the second exemplary alloy. In preferred versions of these embodiments, the majority of the springs in the kit 10 are made entirely from the first exemplary alloy while the remainder of the springs in the kit 10 are made entirely from the second exemplary alloy.

Some exemplary embodiments of the present invention comprise a kit 10 of springs wherein each of the springs in the kit 10 is made entirely from a material selected from the group consisting of the first exemplary alloy and the second exemplary alloy.

Some exemplary embodiments of the present invention comprise at least one firearm spring, or a kit of springs 10, wherein the at least one spring is made entirely from at least one material selected from the group consisting of the first exemplary alloy and the second exemplary alloy.

Some exemplary embodiments of the present invention comprise at least one firearm spring, or a kit of springs 10, wherein the at least one spring comprises at least one material selected from the group consisting of the first exemplary alloy, the second exemplary alloy, the third exemplary alloy, and a mixture comprising at least two materials selected from the group consisting of the first exemplary alloy, the second exemplary alloy, and the third exemplary alloy.

Some exemplary embodiments of the present invention comprise at least one firearm spring, or a kit of springs 10, wherein the at least one spring is made entirely from at least one material selected from the group consisting of the first exemplary alloy, the second exemplary alloy, the third exemplary alloy, and a mixture of at least two materials selected from the group consisting of the first exemplary alloy, the second exemplary alloy, and the third exemplary alloy.

It will be appreciated by those skilled in the art that the present invention can be embodied in other specific forms without departing from the spirit or essential characteristics thereof. One or more rust-proof firearm springs as described may also be set up with other firearms, for example, an M16. It will also be appreciated by those skilled in the art that the embodiments of various rust-proof firearm springs described herein are meant to be illustrative, and do not represent an exclusive list of firearm springs benefiting from the exemplary alloys disclosed herein. The presently disclosed embodiments are therefore considered in all respects to be illustrative and not restricted. The scope of the invention is indicated by the appended claims rather than the foregoing description and all the changes that come within the meaning and range and equivalence thereof are intended to be embraced therein.

What is claimed is:

1. In a rifle having at least one metal coil spring in the rifle firing mechanism, the improvement comprises:

Said at least one spring comprising corrosion resistant metal of at least about 70% nickel, between about 14% to about 17% chromium, between about 5% to about 9% iron, between about 2% to about 3% titanium, between about 0.25% to about 1% aluminum, between about 0.5% to about 1.5% niobium, up to about 0.08% carbon, up to about 1% manganese, up to about 0.02% sulfur, up to about 0.6% silicon, up to about 0.6% copper, and up to about 1.1% cobalt; and wherein the at least one spring is heat treated at a temperature from 1000-1500° F. for 3-5 hours prior to being included in the rifle firing mechanism, to improve durability and strength of the spring.

2. The improvement of claim 1, wherein the at least one spring is heat treated at about 1200° F. for 4 hours prior to being included in the rifle firing mechanism to improve durability and strength of the spring.

3. The improvement of claim 1, wherein the rifle is selected from the group consisting of an AR-15, an AR-10, and an M-16.

* * * * *